US012376663B2

(12) United States Patent
Zheng et al.

(10) Patent No.: US 12,376,663 B2
(45) Date of Patent: Aug. 5, 2025

(54) COSMETIC PACKAGE FOR DISCHARGING A POWDER PRODUCT

(71) Applicant: APR Beauty Group, Inc., Toronto (CA)

(72) Inventors: Min-Yan Zheng, Richmond Hill (CA); Feng-Ying Fu, Markham (CA)

(73) Assignee: APR Beauty Group Inc.

( * ) Notice: Subject to any disclaimer, the term of this patent is extended or adjusted under 35 U.S.C. 154(b) by 410 days.

(21) Appl. No.: 18/161,051

(22) Filed: Jan. 28, 2023

(65) Prior Publication Data

US 2024/0251927 A1 Aug. 1, 2024

(51) Int. Cl.
*A45D 33/12* (2006.01)

(52) U.S. Cl.
CPC ..... *A45D 33/12* (2013.01); *A45D 2200/051* (2013.01)

(58) Field of Classification Search
CPC .. A45D 33/12; A45D 2200/051; A45D 33/00; A45D 34/04; A45D 34/041; A45D 40/26; A45D 40/261; A45D 2200/05
USPC ..... 401/209, 213, 216, 219, 220
See application file for complete search history.

(56) References Cited

U.S. PATENT DOCUMENTS 5,836,320 A * 11/1998 Gueret ..... A45D 33/12 401/218
6,682,244 B2 1/2004 Gueret
8,356,952 B2 1/2013 Bennett et al.

FOREIGN PATENT DOCUMENTS

GB 446424 A 4/1936

* cited by examiner

*Primary Examiner* — David J Walczak
(74) *Attorney, Agent, or Firm* — Jason L DeFrancesco

(57) ABSTRACT

A cosmetic package comprising a roller for discharging a powder product. The cosmetic package comprises an outer cap, an inner cap, an insert, the roller, a container, and a base plug. The container has an open bottom end which is closed by the base plug. The insert is mounted within the container above a cosmetics accommodating space of the container. The roller is disposed rotatably within the cosmetics accommodating space of the container and another portion of the roller extending outside the cosmetics accommodating space from an aperture located in the insert. The inner cap forms a tight seal with the insert and the roller to prevent leakage of powder product from the container.

19 Claims, 14 Drawing Sheets

COSMETIC PACKAGE FOR DISCHARGING A POWDER PRODUCT

BACKGROUND

Field

The present disclosure relates to a cosmetic package for discharging a powder product. More specifically, the present disclosure relates to a cosmetic package having a container for storing the powder product, wherein the cosmetic package includes a roller for discharging the powder product.

Description of the Related Art

Conventional cosmetic packages, for storing and discharging a powder product, usually comprise of a container for storing the powder product, and the powder product is discharged upon orientation of the cosmetic package in a defined angle. The powder product is usually discharged in an uncontrolled amount on to a surface and applied on a skin of the user with an applicator or fingers. The discharging of uncontrolled amount of powder product either leads to multiple dispensing of the powder product during application or dispensing an excessive amount of powder product which leads to a mess and wastage of the powder product. The applicator in these conventional cosmetic packages is usually desegregated from the cosmetic package and stored separately which ultimately leads to carrying of multiple containers.

U.S. Pat. No. 8,356,952 to Rexam Beauty and Closures, Inc., relates to a container for containing and dispensing a cosmetic product. The container includes a base defining a cavity for supporting a cosmetic product and an applicator (for example a trackball, etc.) movably supported at the base to allow a person user to selectively extract the cosmetic product of the cavity. The applicator includes a first portion and a second portion. The first portion is configured to be exposed to the liquid material when the second portion is exposed to the wearer. The container also comprises a lid connected to the base for covering the applicator. The cover may be selectively moved between a closed position and an open position. The applicator is configured to be manipulated by the wearer so that the first portion is exposed to the individual user and that the second portion is exposed to the liquid material.

There is yet a need of developing a cosmetic package that provides a mess free and controlled discharge of the powder product.

SUMMARY

It is an object of the present disclosure to provide a cosmetic package is configured to contain and dispense a powder product.

It is an object of the present disclosure to provide a cosmetic package that discharges a powder product in controlled amount.

The cosmetic package according to present disclosure is therefore designed for providing satisfactory user experience and making the cosmetic package travel friendly and mess-free.

A cosmetic package in accordance with a first embodiment comprises an outer cap, an inner cap, an insert, a roller, a container, and a base plug. The container stores a powder product that is to be discharged onto a surface of the roller, wherein the powder product is selected from at least one of the cosmetic powder products or medicinal powder products. The powder product stored in the container is preferably a loose powder product.

The outer cap covers the cosmetic package and protects the cosmetic package from dust and dirt. The shape of the outer cap is preferably circular in shape. However, the shape of the outer cap may be rectangular, cuboidal, square, or other shapes known in the art.

The container comprises an open upper end and an open bottom end. The container includes a sidewall and a bottom wall defined by a separate base plug. The open bottom end of the container is closed by the base plug. The container is connected with the base plug at the bottom end, thus covering the bottom end of the container to store the powder product. The base plug is fixedly coupled to the container such that they behave as a single unit. In an alternate embodiment, the base plug and the container may be made as a single integral piece.

According to an aspect of the present disclosure, the base plug is connected to the container at the bottom end by means of a snap fitment. However, the base plug may be connected to the container at the bottom end by any other fitment means such as screws, threads, or other fitment means known in the art.

The container has a cavity for accommodating the powder product, and more particularly, the powder product is located in the cosmetics accommodating space in the cavity of the container. Further, the sidewall of the container defines a neck portion near the open upper end of the container. The neck portion is reduced in outer diameter as compared with the rest of the sidewall. The shape of the container is a bowl-shaped container.

According to an aspect of the present disclosure, the dimensions of the container are sufficient enough to accommodate the roller and the insert. The insert is positioned within the container where it fits above the powder product contained within the cosmetics accommodating space of the cavity of the container. The insert is positioned co-axially inside the cavity of the container. The insert comprises an open bottom end and an open upper end. The insert has a hollow structure of a defined geometrical shape. More specifically, the insert has a bowl-shaped structure. The insert further includes a sidewall, an upper horizontal rim, and a skirt wall. The sidewall is concave and shaped like a bowl. The bottom end of the insert fits within the open upper end of the container. An aperture is defined at the bottom end of the insert.

According to another aspect of the present disclosure, the insert further includes at least one protrusion, which may be positioned on an inside of the skirt wall of the insert and may be configured to engage with at least one corresponding groove present on an outer surface of a neck portion of the container. In this manner, the insert may be snap-fitted into the container and may be held within the cavity of the container.

When the insert is coupled with the container, the sidewall of the insert extends along the longitudinal direction of the container in the cavity of the container. The cosmetics accommodating space of the container is formed below the sidewall of the insert, and a space above the upper surface of the sidewall of the insert forms an inner cap receiving space therein. The inner cap receiving space is formed to have a larger cross-sectional area towards the open upper end of the insert. At the bottom end of the sidewall of the insert, the aperture is formed. The inner cap receiving space and the cosmetics accommodating space form independent spaces with the aperture for dispensing the powder product therebetween with the help of the roller.

According to another aspect of the present disclosure, the insert may have a size and shape that corresponds with the size and shape of the container, thereby enclosing the powder product within the cosmetics accommodating space of the cavity of the container. The insert and the container may have a substantially round (e.g., circular or cylindrical) shape in which the seal may be provided by a suitable fastening mechanism, such as snap fastening. However, it is contemplated that the insert and the container may have an alternative shape (e.g., square, rectangular, oval, triangular, or any other shape desired) and may be sealed by a magnetic fastening mechanism, a threading mechanism, or a clamp fastening system.

According to another aspect of the present disclosure, a bottom surface of the sidewall of the insert comprises two support members that extend downwardly therefrom, and the two support members are positioned on at least two opposite sides of the aperture at the open bottom end of the insert.

The at least one end of each of the two support members and is connected to the bottom surface of the sidewall of the insert. Each of the other end of the two support members and is a free end. The two support members include opposing see-through cavities/holes. In various embodiments, the holes of the two support members may or may not be see-through cavity.

In an exemplary embodiment, the roller is spherical in shape and is attached to the support members of the insert at the bottom end of the insert such that at least some portion of the roller is positioned within cosmetics accommodating space the cavity of the container, and at least another portion of the roller extends out from the cosmetics accommodating space through the aperture of the insert. The roller is configured to rotate in a defined direction about an axis for discharging a controlled amount of the powder product from the cosmetics accommodating space of the container through the aperture at the open bottom end of the insert. The powder product adheres on to an outer surface of the roller, on the rotation of the roller by a user. The user collects the powder product from the outer surface of the roller that is exposed from the aperture of the insert.

In alternate embodiments, the roller may be a cylindrical or an oval shape.

In an exemplary embodiment, the roller is manufactured in two parts and is later integrated to form a roller. The two parts of the roller comprised of two halves that are semi-spherical. The roller includes two opposing axle projections on the outer surface of the roller. Each of the two opposing axle projections is partially defined by two halves of the roller. The two halves of the roller are joined together to form the spherical roller and the axle projections. The see-through cavities present in the at least two support members and receive the two opposing axle projections and by which the roller is mounted in position. Thus, the two opposing axle projections of the roller are rotatably connected to the two support members of the insert for free rotation of the roller on a single axis. More particularly, the two support members of the insert comprises of a left support member and a right support member, wherein the left support member and the right support member are connected to the first axle projection and the second axle projection respectively. The roller rotates about an axis lying in direction of the interlocking of the two opposing axle projections with the two support members. At least a portion of the roller is exposed from the open bottom end of the insert for discharging a controlled amount of the powder product for the application.

According to another aspect of the present disclosure, at least a portion of the roller is exposed through the aperture at the bottom end of the insert for application. The roller can rotate in a clockwise and an anti-clockwise direction for discharging the powder product from the top portion. During rotation, an exposed top portion of the roller moves in a downward direction, and a bottom portion of the roller carries the powder product and moves in an upward direction for discharging the powder product. Meanwhile, the top portion of the roller moves downward, touches the powder product and carries a controlled quantity of powder product, and moves upward on further rotation. The movement of the roller covers a complete circle for continuously discharging the powder product during application.

According to another aspect of the present disclosure, the inner cap comprises an open upper end and a closed bottom end. The inner cap includes a flange projection at the upper end thereof, a bottom wall, and a sidewall extending downwardly from the flange projection. The inner cap has a size and shape that corresponds with the size and shape of the container and the insert. The inner cap may be configured to sit above the insert such that the flange projection of the inner cap rests on the upper horizontal rim of the insert, and the sidewall of the insert and the sidewall of the inner cap may flush with one another, thereby enclosing the powder product within the cavity of the container. When the inner cap is placed over the insert, the inner cap forms a tight seal with the insert and the roller to prevent leakage of powder product from the container. More particularly, the sidewall of the inner cap sealingly rests on an upper surface of sidewall of the insert. More particularly, an outer surface of the sidewall of the inner cap includes a protrusion that abuts and make a tight seal with an inner surface of the sidewall of the insert to prevent leakage of powder product from the container between the insert and the inner cap. Further, a bottom surface of the bottom wall of the inner cap includes an annular protrusion that rests on an outer surface of the roller, which is exposed through the aperture, to tight seal and prevents leakage of powder product from the container. The annular protrusion creates a space between the bottom surface of the bottom wall of the inner cap and the top portion of the roller for the reception of a little quantity of the powder product. The diameter of the inner cap is substantially equal to the diameter of the insert.

According to an embodiment, the bottom wall of the inner cap is a convex structure forming a concave cavity at a bottom surface of the bottom wall of the inner cap. The concave cavity provides a space for accommodating the exposed top portion of the roller. The concave cavity is a semi-sphere having a diameter of at least one-third of the diameter of the roller.

According to an embodiment, the concave cavity of the bottom wall covers at least one-third portion of the roller. However, the diameter of the concave cavity of the base may be adjusted for covering a desired portion of the roller depending on the exposure of the roller from the aperture of the insert.

According to the first embodiment, the inner cap is coupled to the insert by a hinge that allows the inner cap to be pivotally connected to the insert by at least one side. The hinge is made proximate to the open upper end of the insert. More particularly, the insert is fixedly coupled to the inner cap about the hinge that provides for pivotal movement of the inner cap relative to the insert between an open position and a closed position. According to the first embodiment, the hinge is a live hinge.

In order to use the cosmetic package of the first embodiment, the user removes the outer cap and pivotally opens the inner cap with respect to the insert. As the inner cap gets in an open position, the user can access the powder product by rotating the roller exposed from the aperture of the insert. The roller may also be rotated using the fingers of the user or any other external tool. More particularly, the user rotates the roller in a direction perpendicular to the direction of the two opposing axle projections and collects the powder product that gets adhered to the surface of the roller on rotation and transfers the powder product to the user's skin. For example, an applicator may be used that touches the surface of the roller to collect the powder product upon rotation of the roller.

In an alternate second embodiment of the present disclosure, the inner cap is integral with an outer cap instead of being integral with the insert. The outer cap of the second embodiment has a top wall and a sidewall that extend downwardly from the top wall. The outer cap has a cylindrical sealing skirt and a cylindrical inner cap that is substantially concentric with the cylindrical sealing skirt. The cylindrical sealing skirt extends from an inner surface of the top wall of the outer cap. The cylindrical sealing skirt abut and forms effectively seals an upper horizontal rim of the insert and thereby sealing the container. The inner cap extends as an annular skirt from the top wall of the inner surface of the outer cap. A plurality of axial ribs extends radially inward from an inner surface of the inner cap. The axial ribs are circumferentially spaced equidistant from each other and encloses an empty space. The axial ribs reinforce the structure strength of the inner cap. A bottom end of the inner cap defines a sealing lip which has reduced thickness than rest of the inner cap.

According to an aspect of the second embodiment, the inner cap is configured to be received in the inner cap receiving space of the insert. The inner cap has a size and shape that corresponds with the size and shape of the aperture of the insert. When the inner cap is placed over the insert, the inner cap forms a tight seal with the insert and the roller to prevent leakage of powder product from the cosmetics accommodating space of the container. More particularly, a bottom edge of the inner cap includes a protrusion that abuts and make a tight seal with the sidewall of the insert to prevent leakage of powder product from the container between the insert and the inner cap. Further, the bottom edge of the inner cap includes the annular sealing lip that rests on an outer surface of the roller, which is exposed through the aperture, to tight seal and prevents leakage of powder.

In the first and second embodiments of the present disclosure, the roller includes two opposing axle projections on the outer surface of the roller and the corresponding holes are present in the two support members of the insert to rotatably accommodate the opposing axle projections by which the roller is mounted in position. However, in a cosmetic package according to an alternate third embodiment, each of the two support members of the insert has an axle projection and corresponding two opposing holes are provided in a roller. Thus, the opposing axle projections of the insert are received in the two opposing holes of the roller for free rotation of the roller on a single axis.

In the first, second, and third embodiments, the roller is attached to the insert. In alternate embodiments, the roller may be attached to the container instead of the insert.

In a cosmetic package according to a fourth embodiment of the present disclosure, the roller is rotatably attached to a base plug instead of attaching to the insert. The base plug comprises two support members extending upwards from a bottom wall of the base plug. The two support members are positioned diametrically opposite on the base plug. Each of the two support members has a free upper end. The two support members of the base plug include opposing holes to rotatably accommodate the opposing axle projections for free rotation of the roller on a single axis. The opposing holes may or may not be see through cavity.

In a cosmetic package according to a fifth embodiment of the present disclosure, the roller is rotatably attached to an inner surface of a sidewall of a container. The inner surface of the sidewall includes two opposing holes to rotatably accommodate the opposing axle projections for free rotation of the roller on a single axis.

It will be understood that the foregoing is only illustrative of the principles of the disclosure and that various modifications can be made by those skilled in the art without departing from the scope and spirit of the disclosure. For example, the shapes and/or sizes of various components can be different from the shapes and sizes are shown herein. As another example, the materials used for various components can be different from those mentioned specifically herein.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
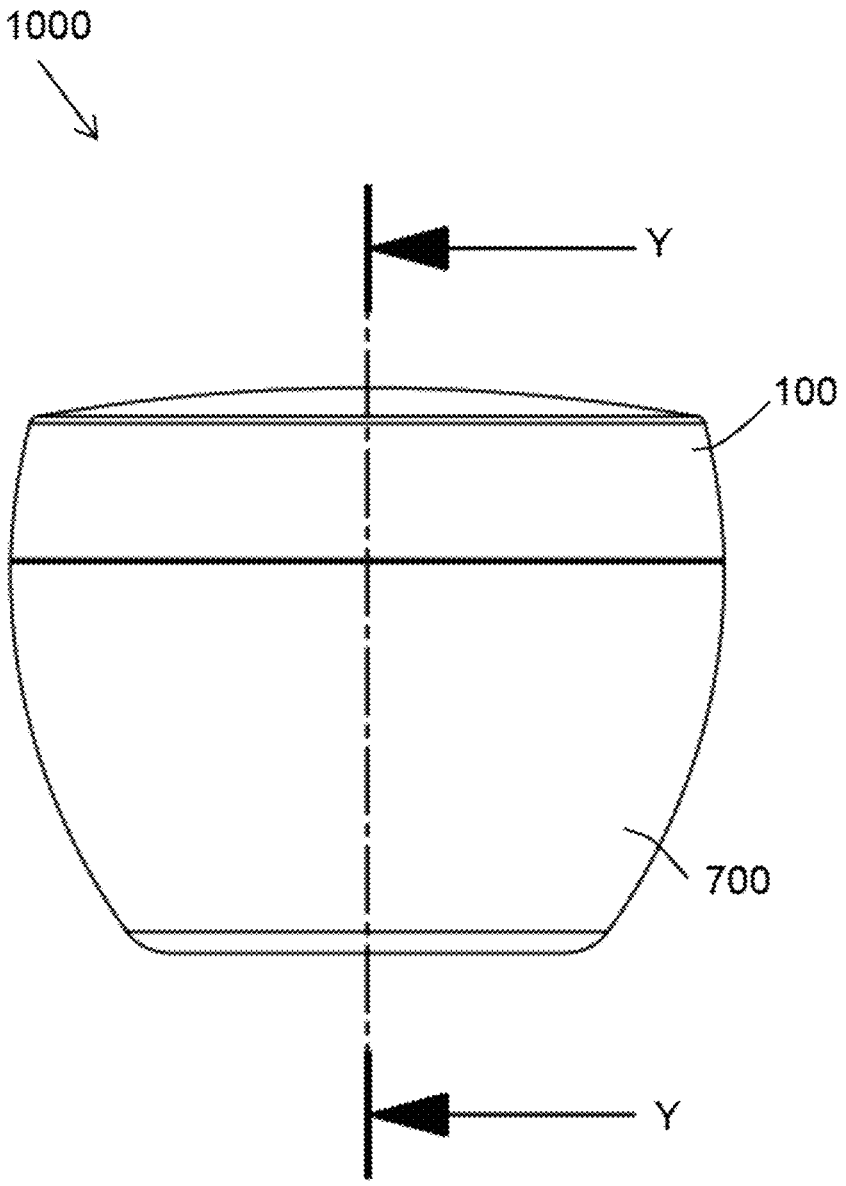
FIG. 1 illustrates a front view of a cosmetic package in a closed state, according to an embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

Throughout this specification, the terms "comprise," "comprises," "comprising" and the like, shall consistently mean that a collection of objects is not limited to those objects specifically recited.

The cosmetic package according to the present disclosure includes an outer cap, an inner cap, an insert, a roller, and a container. When the insert is coupled with the container a sidewall thereof extends along the longitudinal direction of the container in a cavity of the container. The sidewall of the insert defines an aperture. An upper surface of the sidewall of the insert forms an inner cap receiving space to receive the inner cap. In the closed position of the cosmetic package, the inner cap is received in the inner cap receiving space to form a tight seal with the insert and the roller in order to prevent leakage of powder product from a cosmetics accommodating space of the container. At least a portion of the roller is disposed rotatably within the cosmetics accommodating space of the container, and at least another portion of the roller extends outside the cosmetics accommodating space from the aperture of the insert. FIGS. 1-18 illustrates various embodiments of the present disclosure. FIGS. 1-6 and FIGS. 7-12 show possible modifications to the inner cap. FIGS. 13-14, FIGS. 15-16, and FIGS. 17-18 illustrate possible modifications to attachment of the roller.

Figure 2:
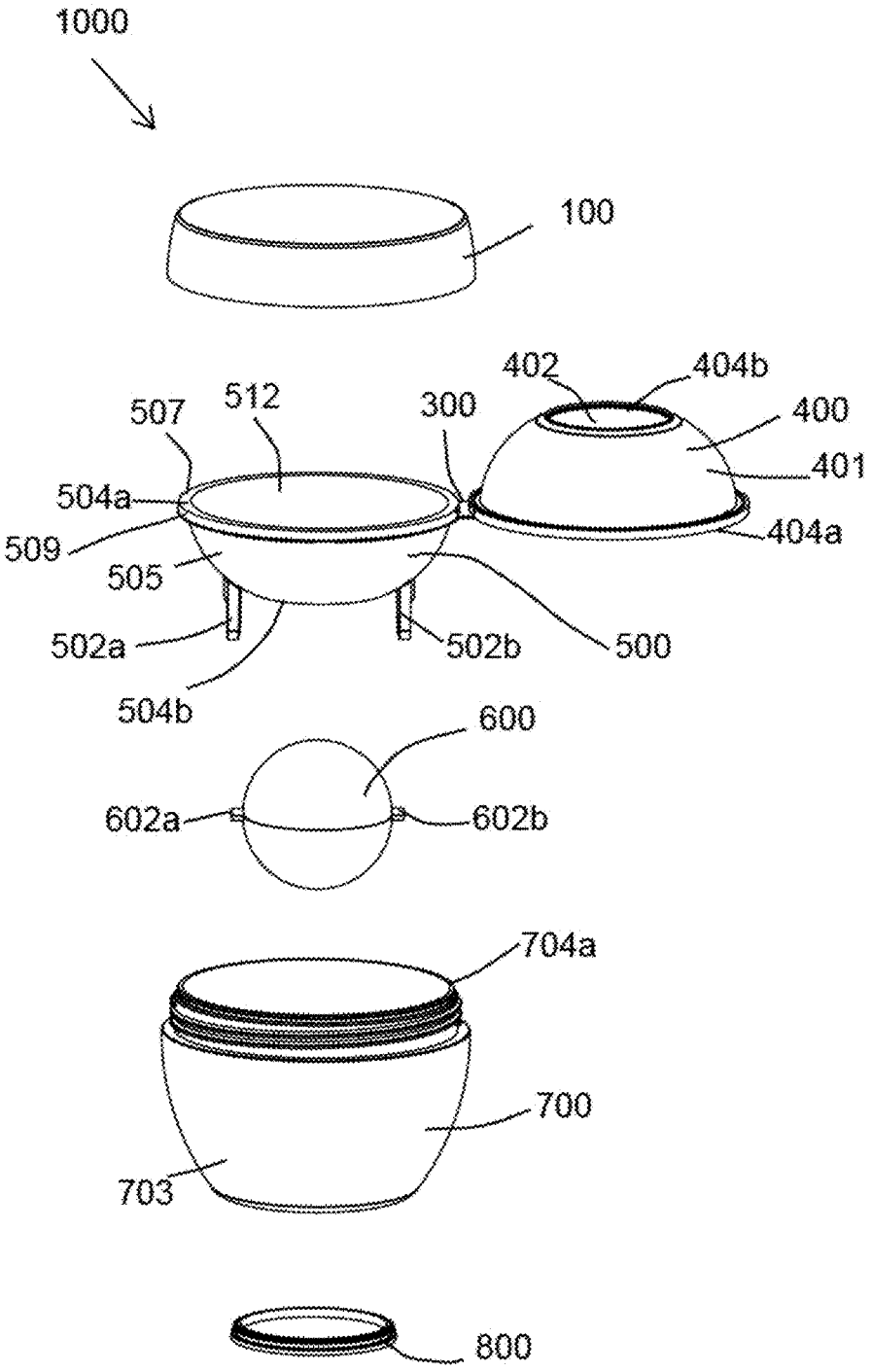
FIG. 2 illustrates an exploded perspective view of the cosmetic package of FIG. 1.

FIGS. 1 to 2 illustrates a cosmetic package 1000 in accordance with a first embodiment of the present disclosure. The cosmetic package 1000 comprises an outer cap 100, an inner cap 400, an insert 500, a roller 600, a container 700, and a base plug 800. The container 700 stores a powder product (not shown) which is to be discharged on to a surface of the roller 600, wherein the powder product is selected from at least one of the cosmetic powder products or medicinal powder products. The powder product stored in the container 700 is preferably a loose powder product.

As shown in FIG. 2, the outer cap 100 covers the container 700 and protects an interior of the container 700 from dust and dirt. The shape of the outer cap 100 is preferably circular in shape. However, the shape of the outer cap 100 may be rectangular, cuboidal, square, or other shapes known in the art.

Figure 3:
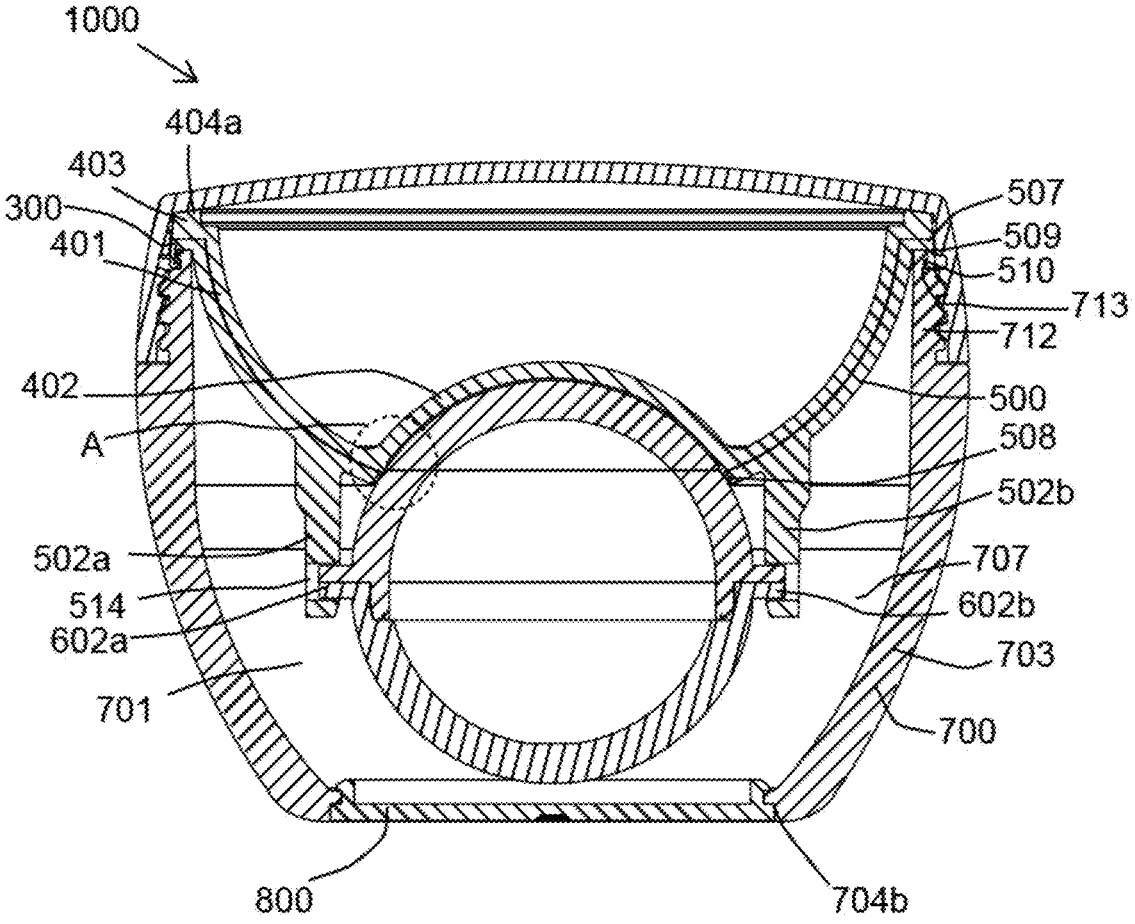
FIG. 3 illustrates a longitudinal cross-sectional view taken along an axis Y-Y of the cosmetic package of FIG. 1.

Referring to FIGS. 2 and 3, the container 700 comprises an open upper end 704*a* and an open bottom end 704*b*. The container 700 includes a sidewall 703 and a bottom wall defined by the base plug 800. The open bottom end 704*b* of the container 700 is closed by the base plug 800. As shown in FIG. 3, the container 700 is connected with the base plug 800 at the open bottom end 704*b*, thus covering the open bottom end 704*b* of the container 700 to store the powder product. The base plug 800 is coupled to the container 700 such that they behave as a single unit. As seen in FIG. 3, the base plug 800 is connected to the container 700 at the open bottom end 704*b* by means of a snap fitment. However, the base plug 800 may be connected to the container 700 at the open bottom end 704*b* by any other fitment means such as screws, threads, or other fitment means known in the art. In an alternate embodiment (not shown), the base plug 800 and the container 700 may be made as a single integral piece.

As shown in FIG. 3, further, the container 700 has a cavity 707 for accommodating the powder product, and more particularly, the powder product is located in a cosmetics accommodating space 701 in the cavity 707 of the container 700. Further, the sidewall 703 of the container 700 defines a neck portion 712 near the open upper end 704*a* of the container 700. The neck portion 712 is reduced in outer diameter as compared with the rest of the sidewall 703. The shape of the container 700 is a bowl-shaped container.

The dimensions of the container 700 are sufficient enough to accommodate the roller 600 and the insert 500.

As seen in FIG. 3, the insert 500 is positioned within the container 700 where it fits above the powder product contained within the cosmetics accommodating space 701 of the cavity 707 of the container 700. The insert 500 is positioned co-axially inside the cavity 707 of the container 700. Further referring to FIGS. 2 and 6, the insert 500 comprises an open bottom end 504*b* and an open upper end 504*a*. The insert 500 has a hollow structure of a defined geometrical shape. More specifically, the insert 500 is has a bowl-shaped structure. The insert 500 further includes a sidewall 505, an upper horizontal rim 507, and a skirt wall 509. The sidewall 505 of the insert 500 is concave and shaped like a bowl. An aperture 508 is defined at the open bottom end 504*b* of the insert 500. The skirt wall 509 depends from an outer edge of the upper horizontal rim 507 of the insert 500, the sidewall of the insert 500 descends downwardly from an inner edge of the upper horizontal rim 507. The upper horizontal rim 507 and the skirt wall 509 thus form a structure that overlaps the open upper end 704*a* of the container 700, refer FIG. 3. This overlapping structure anchors the insert 500 securely in the cavity 707 of the container 700.

As shown in FIG. 3, the insert 500 includes coupling features to be engaged with corresponding coupling features on an outer surface of the neck portion 712 of the container 700. The insert 500 further includes at least one protrusion 510, which may be positioned on an inner side of the skirt wall 509 of the insert 500 and may be configured to engage with at least one corresponding groove 713 present on the outer surface of the neck portion 712 of the container 700. In this manner, the insert 500 may be snap-fitted into the container 700 and may be held within the cavity 707 of the container 700.

When the insert 500 is coupled with the container 700, the sidewall 505 extends along the longitudinal direction of the container 700 in the cavity 707 of the container 700. The cosmetics accommodating space 701 of the container 700 is formed below the sidewall 505, and a space above the upper surface of the sidewall 505 of the insert 500 forms an inner cap receiving space 512 therein, see FIG. 2. The inner cap receiving space 512 is formed to have a larger cross-sectional area towards the open upper end 504*a*. The aperture 508 is formed at the end of the sidewall 505. The inner cap receiving space 512 and the cosmetics accommodating space 701 form independent spaces with the aperture 508 for dispensing the powder product there between with the help of the roller 600.

The insert 500 may have a size and shape that corresponds with the size and shape of the container 700, thereby enclosing the product within the cosmetics accommodating space 701 of the container 700. The insert 500 and the container 700 may have a substantially round (e.g., circular or cylindrical) shape in which a seal may be provided by a suitable fastening mechanism, such as snap fastening as shown in FIG. 3. However, it is contemplated that the insert 500 and the container 700 may have an alternative shape (e.g., square, rectangular, oval, triangular, or any other shape desired) and may be sealed by a magnetic fastening mechanism, a threading mechanism, or a clamp fastening system.

Referring to FIGS. 2, 3, 5 and 6, a bottom surface of the sidewall 505 of the insert 500 comprises two support members 502*a* and 502*b* extending downwardly therefrom, and are positioned on at least two opposite sides of the aperture 508 at the open bottom end 504*b* of the insert 500. At least one end of each of the two support members 502*a* and 502*b* is connected to the bottom surface of the sidewall 505 of the insert 500. Each of another end of the two support members 502*a* and 502*b* is a free end. The two support members 502*a* and 502*b* include two opposing holes 514. The two opposing holes 514 may or may not be see through cavities.

In exemplary embodiment, as shown in FIG. 3, the roller 600 is spherical in shape and is attached to the support members 502*a* and 502*b* of the insert 500 near the bottom end portion of the insert 500 such that at least some portion of the roller 600 is positioned within the cosmetics accommodating space 701 of the cavity 707 of the container 700, and at least another portion of the roller 600 extends out from the cosmetics accommodating space 701 through the aperture 508 of the insert 500. The roller 600 is configured to rotate in a defined direction about an axis for discharging a controlled amount of the powder product from the cosmetics accommodating space 701 of the container 700 through the aperture 508 of the insert 500. The powder product adheres on to an outer surface of the portion of the roller 600 that is positioned inside the cosmetics accommodating space 701, and on the rotation of the roller 600, the portion of the roller 600 is exposed outside from the aperture 508 of the insert 500 allowing a user to collect the powder product from the outer surface of the roller 600.

In exemplary embodiment, as shown FIGS. 2 and 3, the roller 600 is manufactured in two parts and is later integrated to form the roller 600. The two parts of the roller 600 comprises two halves that are semi-spherical. The roller 600 includes two opposing axle projections 602*a*, 602*b* on the outer surface of the roller 600. Each of the two opposing axle projections 602*a*, 602*b* is partially defined by two halves of the roller 600. The two halves of the roller 600 are joined together to form the roller 600 and the two opposing axle projections 602*a*, 602*b*, namely a first axle projection 602*a* and a second axle projection 602*b*. The two opposing holes 514 present in the two support members 502*a* and 502*b* rotatably accommodate the opposing axle projections 602*a* and 602*b* by which the roller 600 is mounted in position. Thus, the opposing axle projections 602*a* and 602*b* of the roller 600 are connected to the two support members 502*a* and 502*b* respectively of the insert 500 for free rotation of the roller 600 on a single axis. More particularly, the two support members 502*a*, 502*b* of the insert 500 comprises of a left support member 502*a* and a right support member 502*b*, wherein the left support member 502*a* and the right support member 502*b* are connected to the first axle projection 602*a* and the second axle projection 602*b* respectively, refer FIG. 3. The roller 600 rotates about an axis lying in direction of the interlocking of the two opposing axle projections 602*a* and 602*b* with the support members 502*a* and 502*b*.

As shown in FIG. 2, at least a portion of the roller 600 is exposed through the aperture 508 the open bottom end 504*b* for application. The roller 600 can rotates in a clock-wise and an anti-clockwise direction for discharging the powder product. During rotation, an exposed top portion of the roller 600 moves in a downward direction, and a bottom portion of the roller 600 that is accommodated in the cosmetics accommodating space 701 carries the powder product and moves in an upward direction for discharging the powder product. Meanwhile, the top portion of the roller 600 moves downward, touches the powder product and carries a controlled quantity of powder product, and moves upward on further rotation. The movement of the roller 600 covers a complete circle for continuously discharging the powder product during application.

Figure 4:
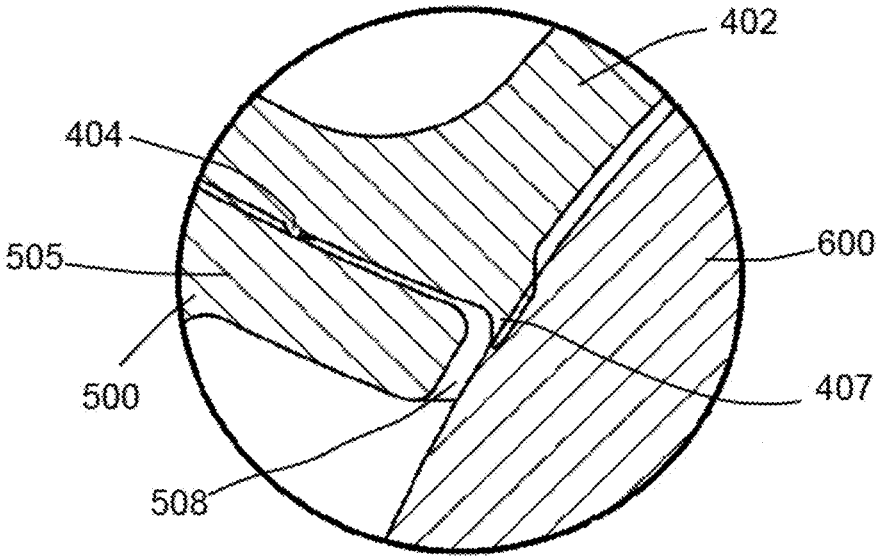
FIG. 4 illustrates an enlarged view of a circle A of FIG. 3.
Figure 5:
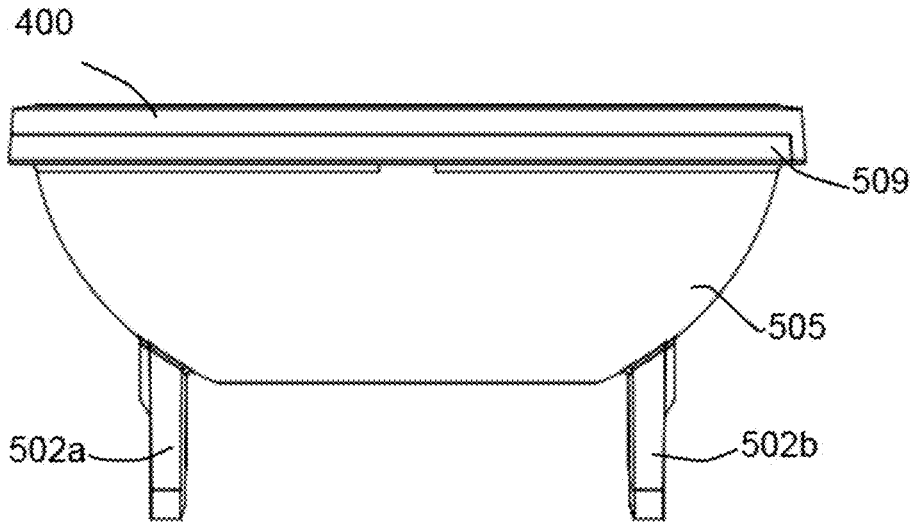
FIG. 5 illustrates a front view of an insert and inner cap assembly of FIG. 2.
Figure 6:
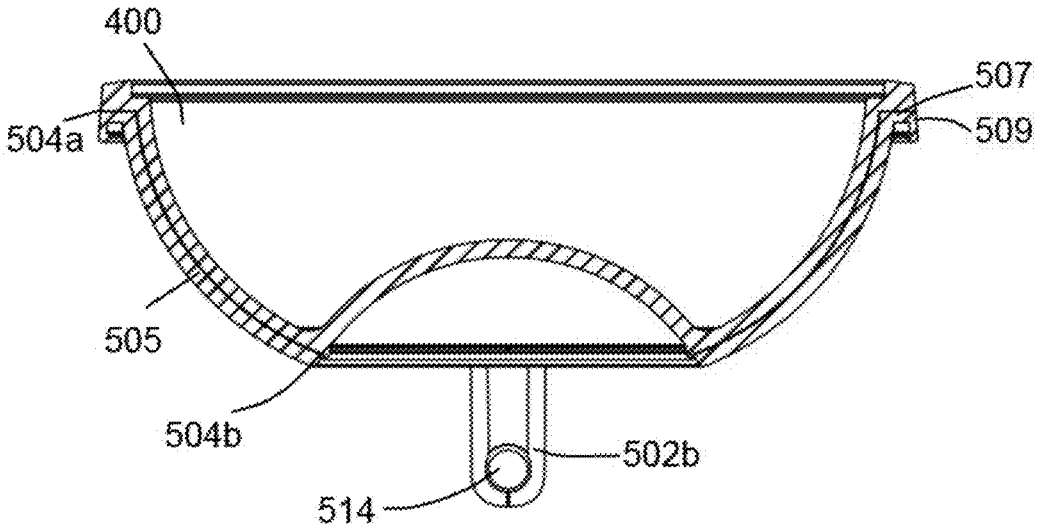
FIG. 6 illustrates a longitudinal cross-sectional view of the FIG. 5.

As shown in FIGS. 2 and 6, the inner cap 400 comprises an open upper end 404*a* and a closed bottom end 404*b*. The inner cap 400 includes a flange projection 403 at the open upper end 404*a* thereof, a bottom wall 402, and a sidewall 401 extending downwardly from the flange projection 403. The inner cap 400 has a size and shape that corresponds with the size and shape of the container 700 and the insert 500. The inner cap 400 is configured to be received in the inner cap receiving space 512 of the insert 500 such that the flange projection 403 of the inner cap 400 rests on the upper horizontal rim 507 of the insert 500, and the sidewall 505 of the insert 500 and the sidewall 401 of the inner cap 400 may be flushed with one another, thereby enclosing the powder product within the cosmetics accommodating space 701 of the container 700. When the inner cap 400 is placed over the insert 500, the inner cap 400 forms a tight seal with the insert 500 and the roller 600 to prevent leakage of powder product from the cosmetics accommodating space 701 of the container 700. More particularly, the sidewall 401 of the inner cap 400 sealingly rests on an upper surface of the sidewall 505 of the insert 500. More particularly, as shown in FIG. 4, an outer surface of the sidewall 401 of the inner cap 400 includes a protrusion 404 that abuts and make a tight seal with an inner surface of the sidewall 505 of the insert 500 to prevent leakage of powder product from the container 700 between the insert 500 and the inner cap 400. Further, a bottom surface of the bottom wall 402 of the inner cap 400 includes an annular protrusion 407 that rests on an outer surface of the roller 600, which is exposed through the aperture 508, to tight seal and prevents leakage of powder product from the container 700. The annular protrusion 407 creates a space between the bottom surface of the bottom wall 402 of the inner cap 400 and the top portion of the roller 600 for the reception of a little quantity of the powder product. The diameter of the inner cap 400 is substantially equal to the diameter of the insert 500.

According to an embodiment, the bottom wall 402 of the inner cap 400 is a convex structure forming a concave cavity at a bottom surface of the bottom wall 402. The concave cavity provides a space for accommodating the exposed top portion of the roller 600. The concave cavity is a semi-sphere having a diameter of about at least one-third of the diameter of the roller 600.

According to an embodiment, the concave cavity of the bottom wall 402 covers at least one-third portion of the roller 600. However, the diameter of the concave cavity of the bottom wall 402 may be adjusted for covering a desired portion of the roller 600 depending on the exposure of the roller 600 from the aperture 508 of the insert 500.

The inner cap 400, and the insert 500 along with the roller 600 are positioned co-axially connecting one another in the above sequence.

As shown in FIG. 6, the inner cap 400 is coupled to the insert 500 by a hinge 300 that allows the inner cap 400 to be pivotally connected to the insert 500 by at least one side. The hinge 300 is made proximate to the open upper end 504*a*. More particularly, the insert 500 is fixedly coupled to the inner cap 400 about the hinge 300 that provides for pivotal movement of the inner cap 400 relative to the insert 500 between an open position and a closed position. According to the embodiment illustrated, the hinge 300 is a live hinge.

In order to use the cosmetic package 1000, the user removes the outer cap 100 and pivotally opens the inner cap 400. As the inner cap 400 gets in an open position, the user can access the powder product by rotating the roller 600 exposed from the aperture 508 of the insert 500.

The user rotates the roller 600 in a direction perpendicular to the direction of the two opposing axle projections 602*a* and 602*b* and collects the powder product that gets adhered to the surface of the roller 600 on rotation and transfers the powder product to the user's skin. The roller 600 may be rotated using the fingers of the user or any other tool. For example, an applicator may be used that touches the surface of the roller 600 to collect the powder product upon rotation of the roller 600.

Figure 7:
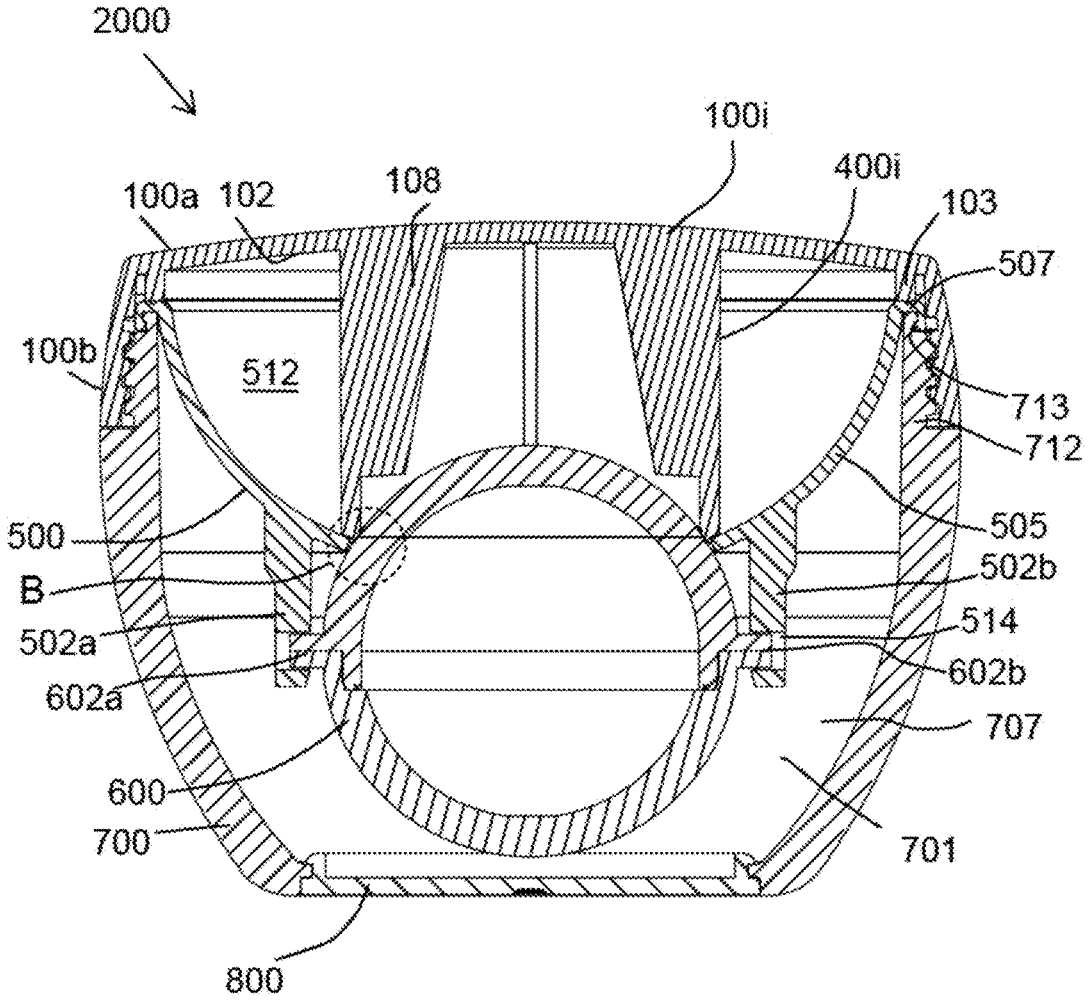
FIG. 7 illustrates a cross-sectional view of a cosmetic package according to a second embodiment of the present disclosure.
Figure 8:
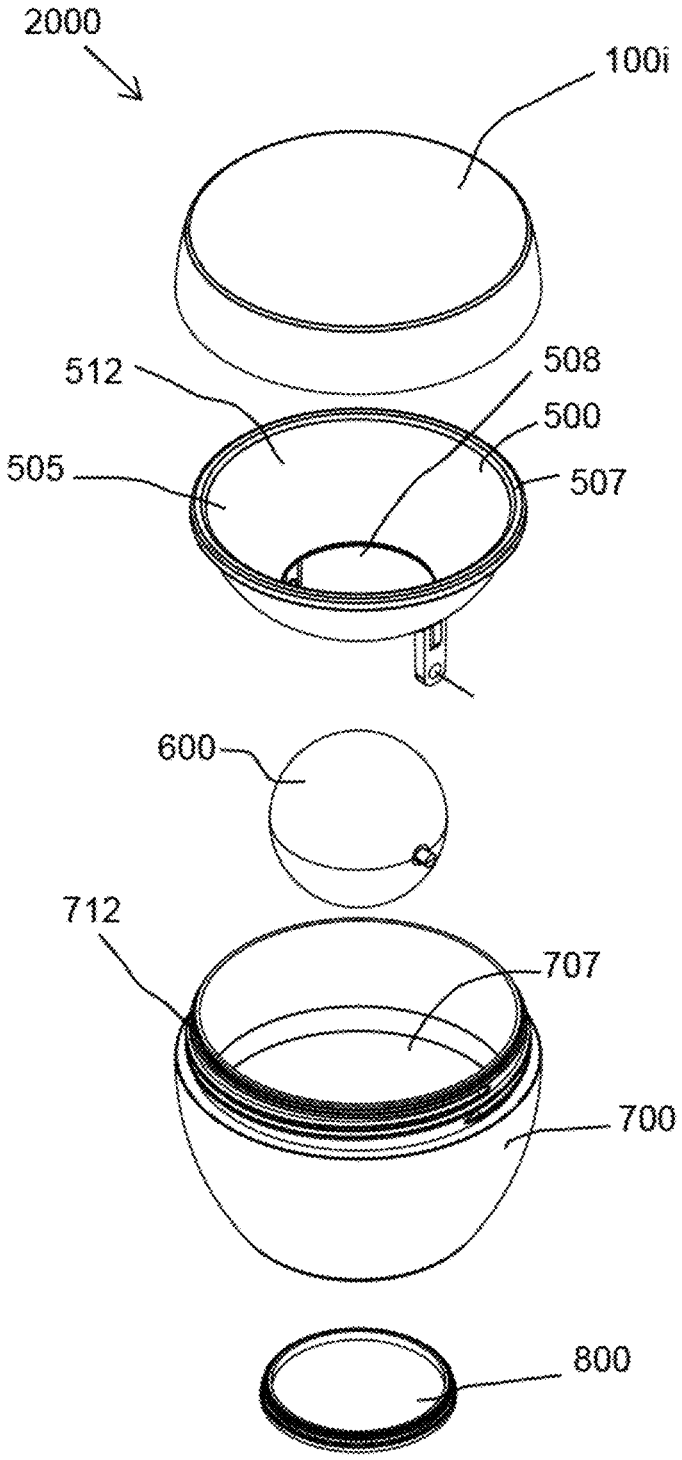
FIG. 8 illustrates an exploded view of the cosmetic package of FIG. 7.
Figure 9:
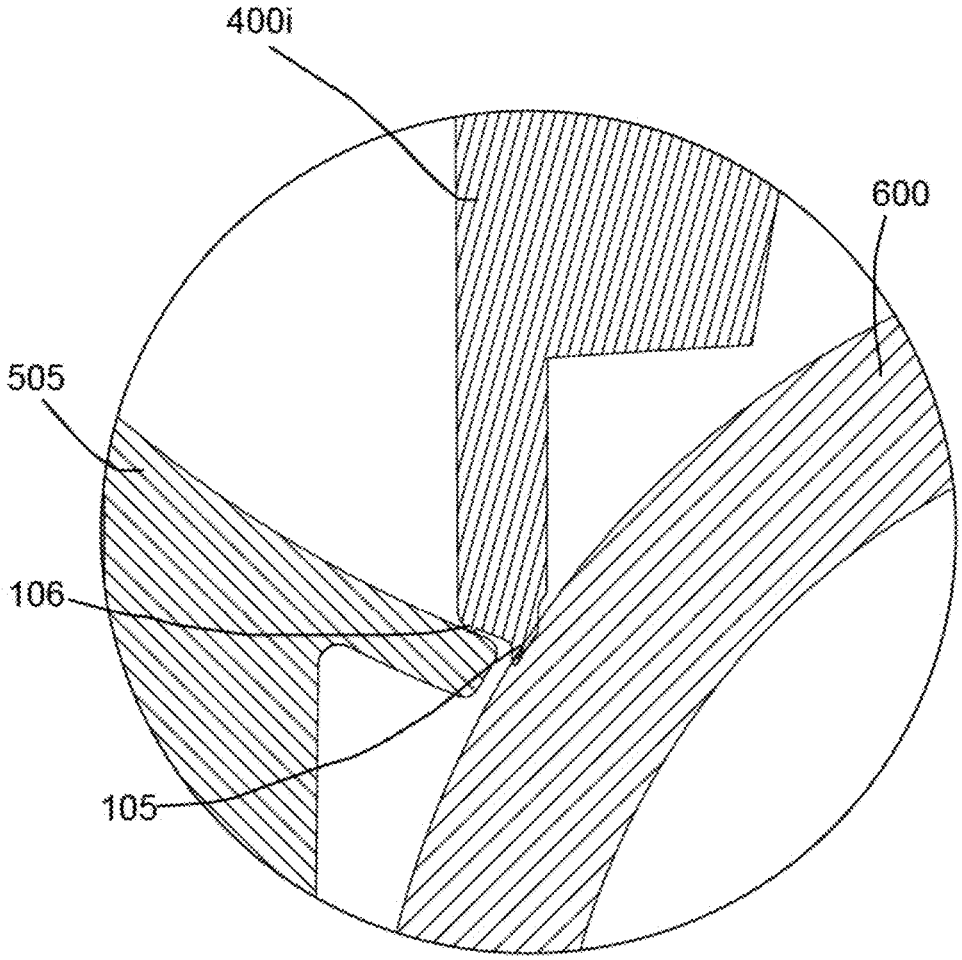
FIG. 9 illustrates an enlarged view of a circle B of FIG. 7.

FIGS. 7 to 12 show a cosmetic package 2000 and its components according to a second embodiment of the present disclosure. The cosmetic package 2000 is similar in construction to the cosmetic package 1000 of the first embodiment except in that an inner cap 400*i* is integrally provided with an outer cap 100*i* instead of being integral with an insert 500. The structure of the inner cap 400*i* and the outer cap 100*i* of the second embodiment differs from structure of the inner cap 400 and the outer cap 100 of the first embodiment. The cosmetic package 2000 comprises a container 700, a base plug 800, a roller 600, an insert 500, an inner cap 400*i*, and the outer cap 100*i*, as shown in FIGS. 7 and 8.

Figure 10:
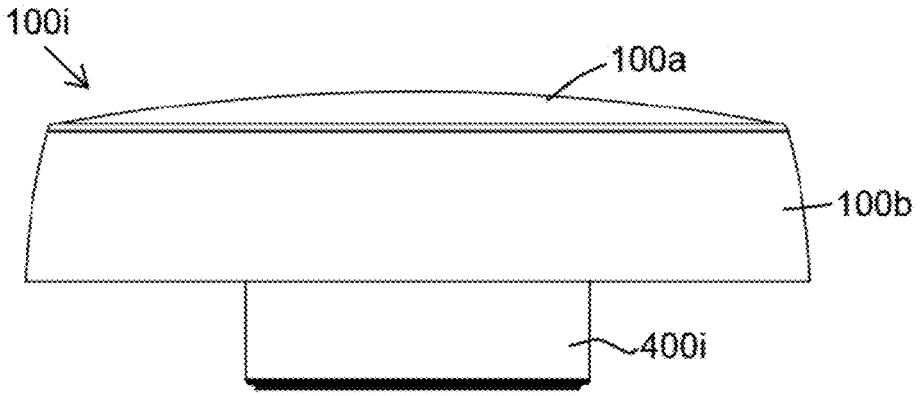
FIG. 10 illustrates a front view of an outer cap of the cosmetic package of FIG. 8.
Figure 11:
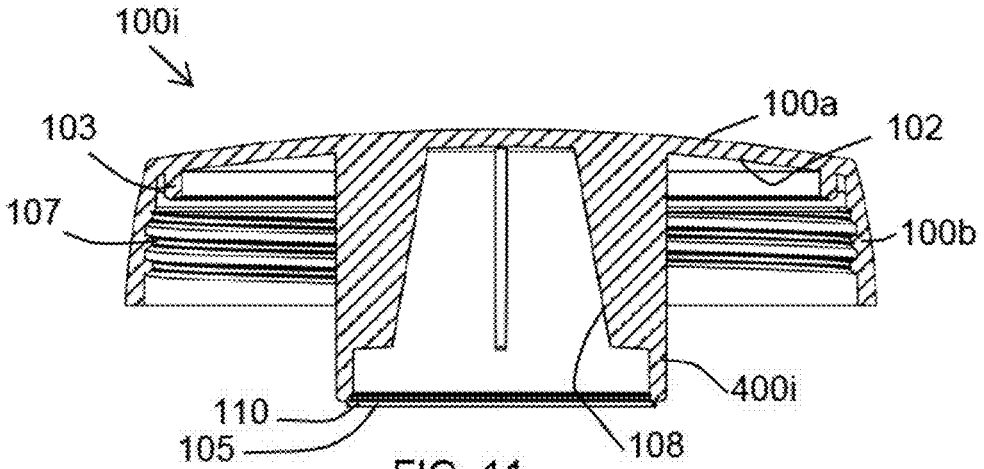
FIG. 11 illustrates a cross-sectional view of the outer cap of FIG. 10.
Figure 12:
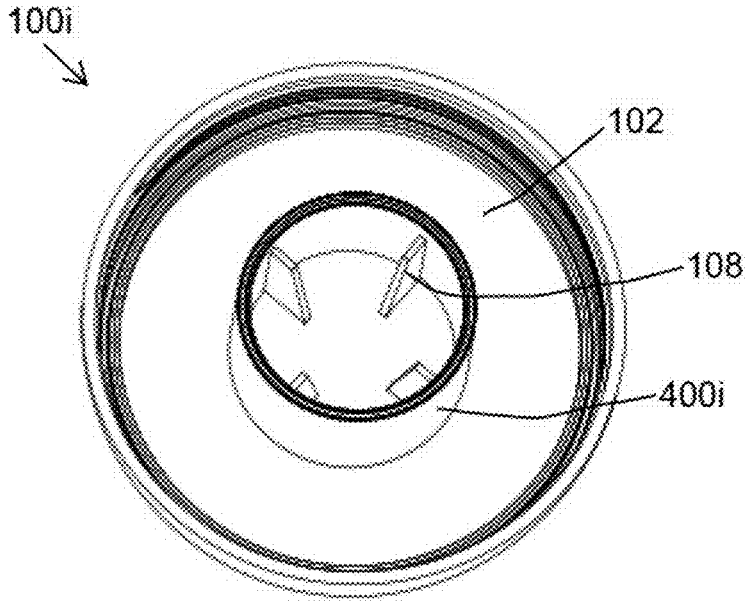
FIG. 12 illustrates a bottom perspective view of the outer cap of FIG. 10.

Referring to FIGS. 10-12, the outer cap 100*i* has a top wall 100*a* and a sidewall 100*b* that extend downwardly from the top wall 100*a*. An inner surface of the sidewall 100*b* is provided with threads 107 to engage on the complementary threads provided on outer surface at an upper end portion of the container 700. The outer cap 100 has a cylindrical sealing skirt 103 and the inner cap 400*i*. The inner cap 400*i* is cylindrical and substantially concentric with the cylindrical sealing skirt 103. The cylindrical sealing skirt 103 extends from an inner surface 102 of the top wall 100*a* of the outer cap 100. The cylindrical sealing skirt 103 abut and forms effectively seals an upper horizontal rim 507 of the insert 500 and thereby sealing the container 700, refer FIG. 7.

Further, referring to FIGS. 7, 11 and 12, the inner cap 400*i* extends as an annular skirt from the top wall 100*a* of the inner surface 102 of the outer cap 100. A plurality of axial ribs 108 extend radially inward from an inner surface of the inner cap 400*i*. The axial ribs 108 are circumferentially spaced equidistant from each other and encloses an empty space. The axial ribs 108 reinforce the structure strength of the inner cap 400*i*. A bottom end 110 of the inner cap 400*i* defines an annular sealing lip 105 which has reduced thickness than rest of the inner cap 400*i*.

A shown in FIG. 7 the inner cap 400*i* is configured to be received in the inner cap receiving space 512 of the insert 500. The inner cap 400*i* has a size and shape that corresponds with the size and shape of the aperture 508 of the insert 500. When the inner cap 400*i* is placed over the insert 500, the inner cap 400*i* forms a tight seal with the insert 500 and the roller 600 to prevent leakage of powder product from the cosmetics accommodating space 701 of the container 700. More particularly, referring to FIG. 9, a bottom edge of the inner cap 400*i* includes a protrusion 106 that abuts and make a tight seal with the sidewall 505 of the insert 500 to prevent leakage of powder product from the container 700 between the insert 500 and the inner cap 400*i*. Further, the bottom edge of the inner cap 400 includes the annular sealing lip 105 that rests on an outer surface of the roller 600, which is exposed through the aperture 508, to tight seal and prevents leakage of powder.

Figure 13:
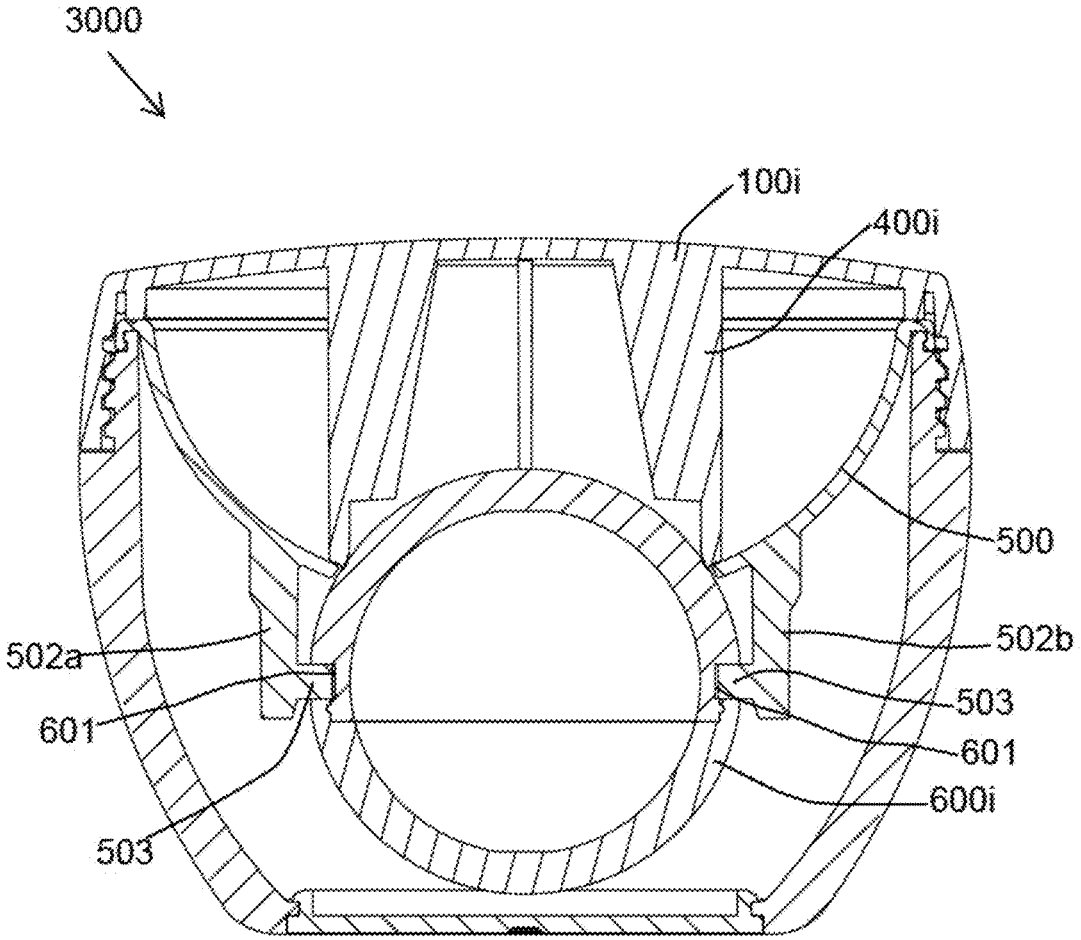
FIG. 13 illustrates a cross-sectional view of a cosmetic package according to a third embodiment of the present disclosure.
Figure 14:
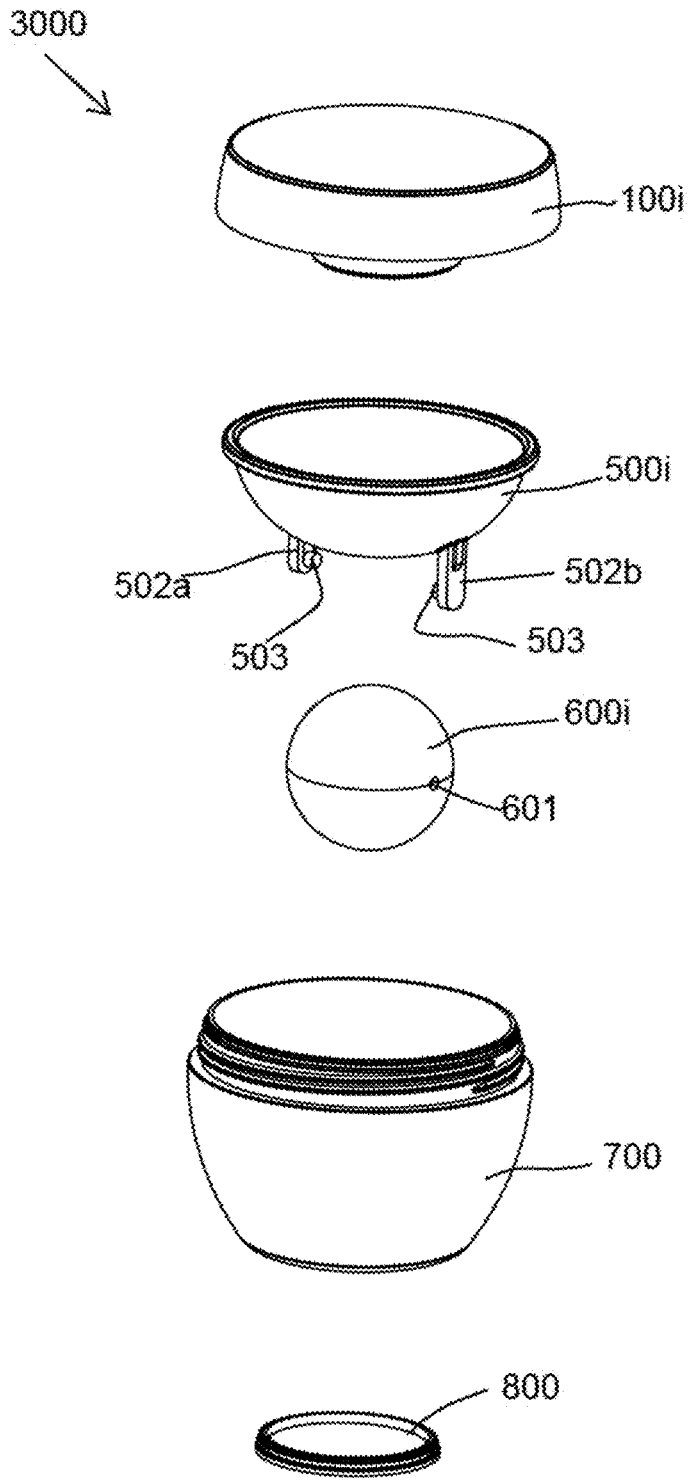
FIG. 14 illustrates an exploded view of the cosmetic package of FIG. 13.

In the first and second embodiments of the present disclosure, refer FIGS. 3 and 7, the roller 600 includes two opposing axle projections 602*a*, 602*b* on the outer surface of the roller 600 and the corresponding two opposing holes 514 are present in the two support members 502*a* and 502*b* of the insert 500 to rotatably accommodate the two opposing axle projections 602*a* and 602*b* by which the roller 600 is mounted in position. However, in a cosmetic package 3000 according to an alternate third embodiment, as shown in FIGS. 13 & 14, each of the two support members 502*a* and 502*b* of the insert 500 has an axle projection 503 and corresponding two opposing holes 601 are provided in a roller 600*i*. Thus, the two opposing axle projections 503 of the insert 500 are received in the two opposing holes 601 of the roller for free rotation of the roller 600 on a single axis. The rest of the construction of the cosmetic package 3000 of the third embodiment is similar to the cosmetic package 2000 of the second embodiment of the present disclosure.

In the first, second, and third embodiments, the roller 600 is attached to the insert 500. In alternate embodiments, the roller may be attached to the container instead of the insert 500.

Figure 15:
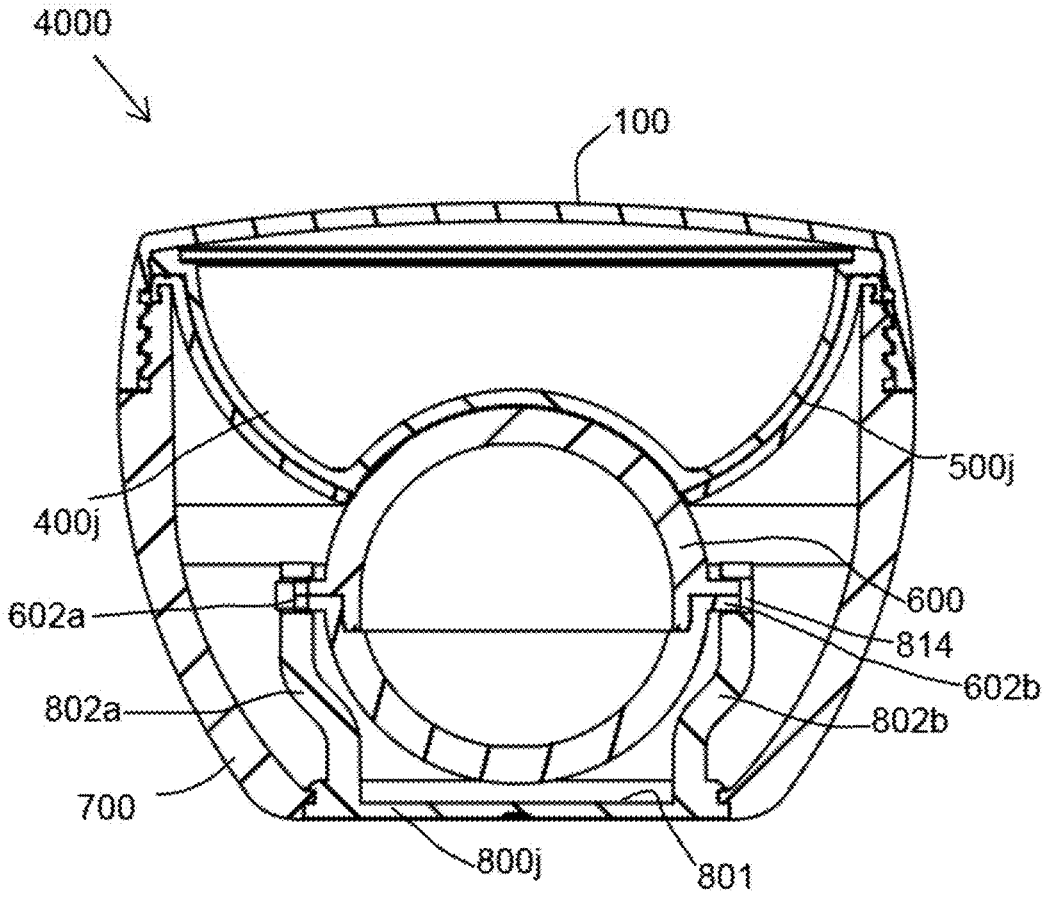
FIG. 15 illustrates a cross-sectional view of a cosmetic package according to a fourth embodiment of the present disclosure.
Figure 16:
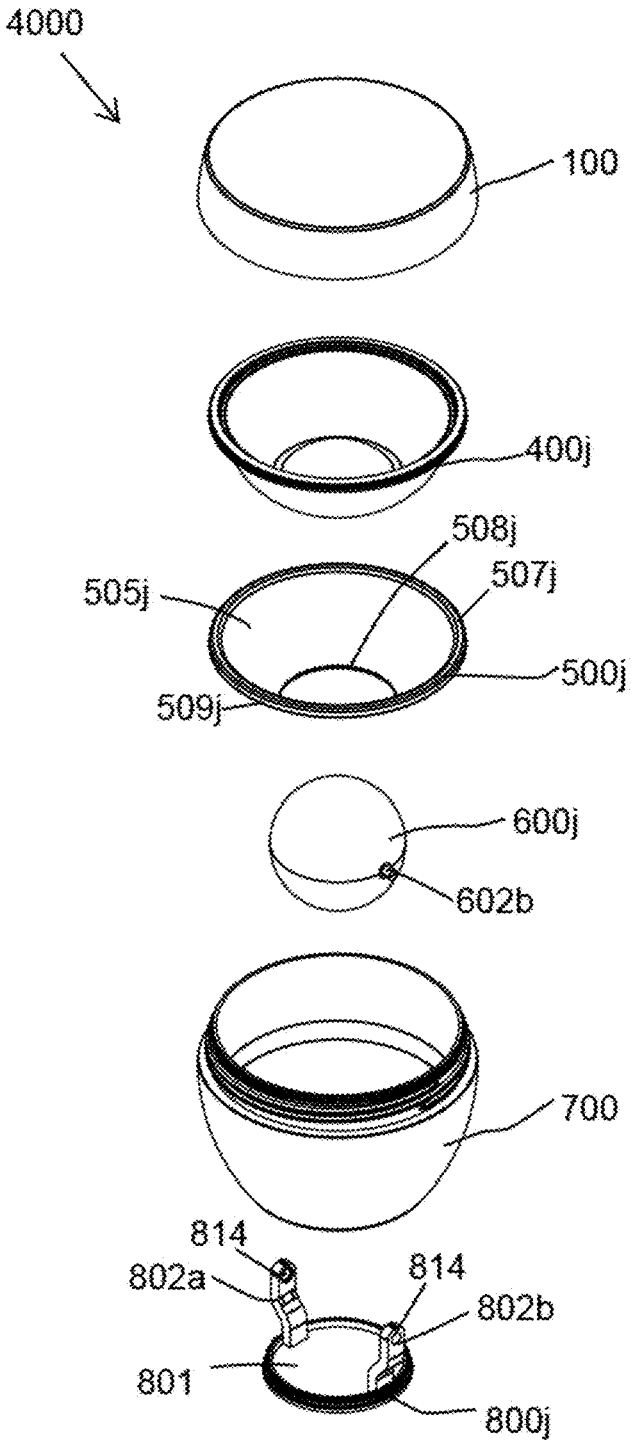
FIG. 16 illustrates an exploded view of the cosmetic package of FIG. 15.

FIGS. 15 and 16, show a cosmetic package 4000 according to a fourth embodiment of the present disclosure. The roller 600 is rotatably attached to a base plug 800*j* instead of attaching to an insert 500*j*. The cosmetic package 4000 comprises an outer cap 100, an inner cap 400*j*, the insert 500*j*, a roller 600, a container 700, and the base plug 800*j*. The inner cap 400*j* is similar to the inner cap 400 of the first embodiment except in that the inner cap 400*j* of the fourth embodiment is not pivotably attached to the insert 500*j* by a hinge. The insert 500*j* is positioned within the container 700 where it fits above a powder product contained within the cosmetics accommodating space 701 of the cavity 707 of the container 700. The insert 500*j* includes a sidewall 505*j*, an upper horizontal rim 507*j*, and a skirt wall 509*j*. The sidewall 505*j* of the insert 500 is concave and shaped like a bowl and an aperture 508*j* is defined at the bottom end of the insert 500*j*. A portion of the roller 600 projects out from the aperture 508*j* of the insert 500*j*. The base plug 800*j* comprises two support members 802*a* and 802*b* extending upwards from a bottom wall 801 of the base plug 800*j*. The two support members 802*a* and 802*b* are positioned diametrically opposite on the base plug 800*j*. Each of the two support members 802*a* and 802*b* has a free upper end. The two support members 802*a* and 802*b* include two opposing holes 814 to rotatably accommodate the opposing axle projections 602*a* and 602*b* for free rotation of the roller 600 on a single axis. The opposing holes 814 may or may not be see through.

In order to use the cosmetic package 4000, the user unscrews the outer cap 100 and removes the inner cap 400 *j* from the container 700. As the inner cap 400 *j* gets removed from the container 700, the user can access the powder product by rotating the roller 600 exposed from the aperture of the insert 500 *j*.

Figure 17:
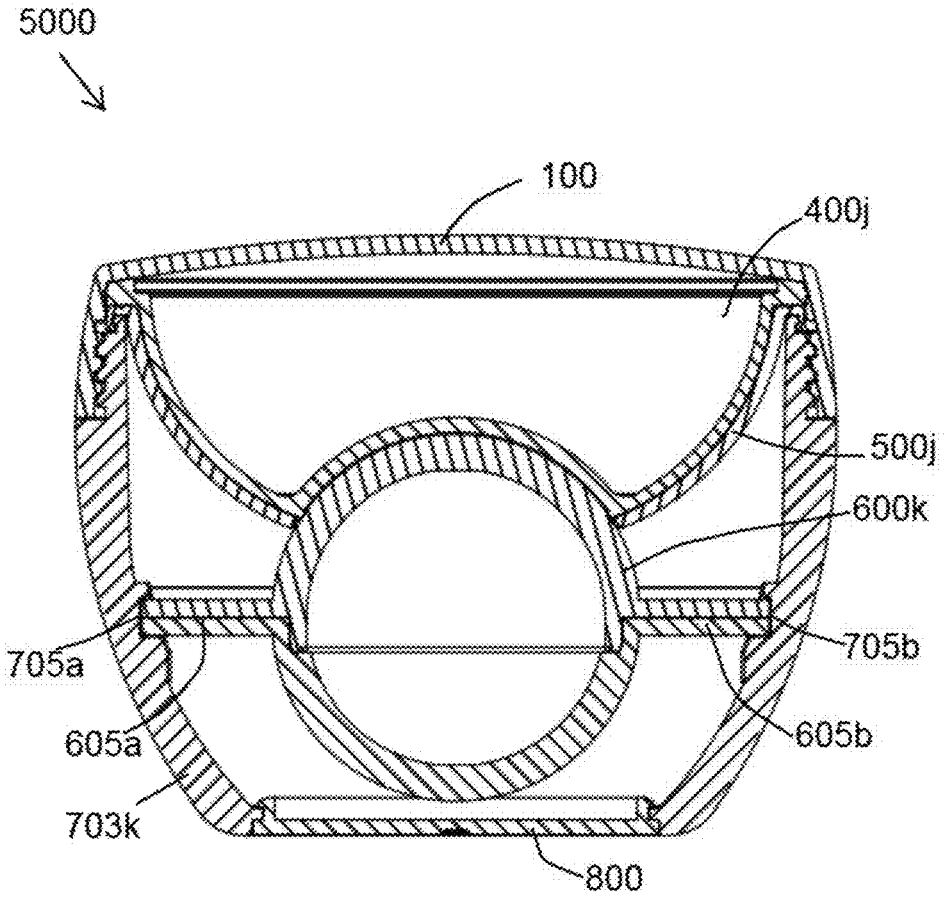
FIG. 17 illustrates a cross-sectional view of a cosmetic package according to a fifth embodiment of the present disclosure.
Figure 18:
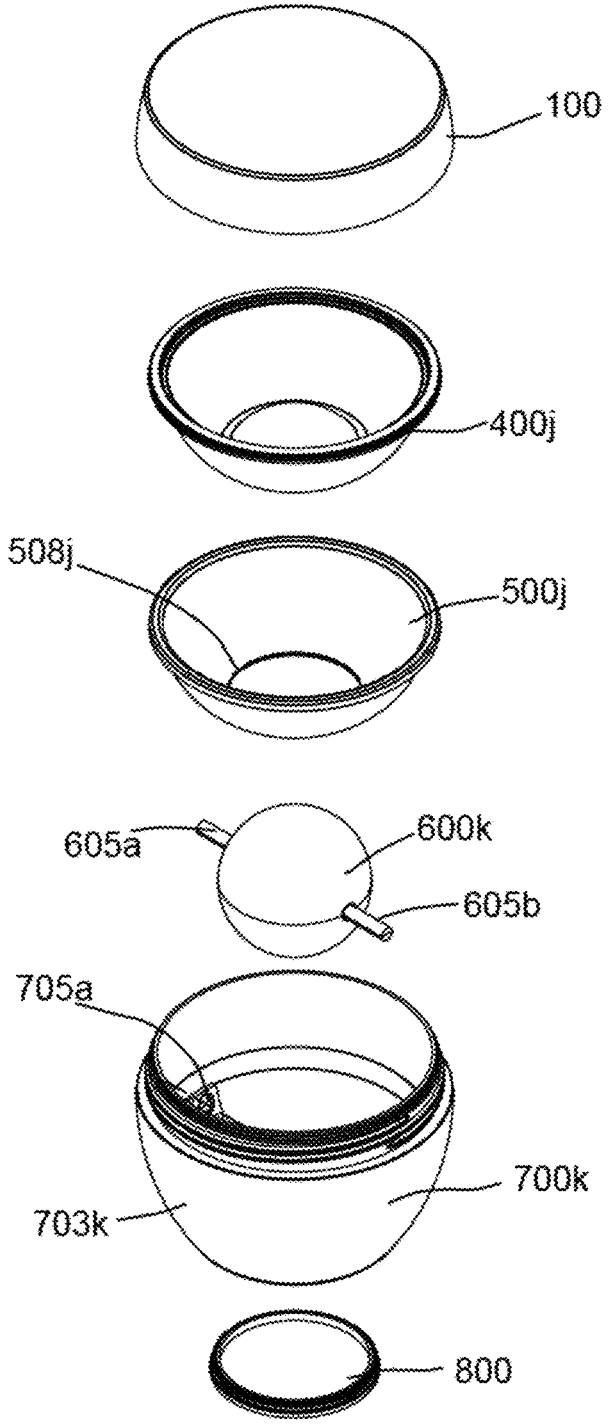
FIG. 18 illustrates an exploded view of the cosmetic package of FIG. 17.

FIGS. 17 and 18, show a cosmetic package 5000 according to a fifth embodiment of the present disclosure. A roller 600*k* of fifth embodiment is rotatably attached to an inner surface of a sidewall 703*k* of a container 700*k*. The cosmetic package 5000 comprises an outer cap 100, the inner cap 400*j*, an insert 500*j*, the roller 600*k*, the container 700*k*, and the base plug 800. The structure of the inner cap 400*j* and the insert 500*j* of the present embodiment is similar to the inner cap 400*i* and the insert 500*i* of the fourth embodiment. The roller 600*k* projects out from the aperture 508*j* of the insert 500*j*. The inner surface of the sidewall 703*k* includes two opposing holes 705*a* and 705*b* to rotatably accommodate two opposing axle projections 605*a* and 605*b* of the roller 600*k* for free rotation of the roller 600*k* on a single axis.

It will be understood that the foregoing is only illustrative of the principles of the disclosure, and that various modifications can be made by those skilled in the art without departing from the scope and spirit of the disclosure. For example, the shapes and/or sizes of various components can be different from the shapes and sizes shown herein. As another example, the materials used for various components can be different from those mentioned specifically herein.

What is claimed is:

1. A cosmetic package for discharging a powder product comprising:

a container comprising a cavity extending between an open upper end and an open bottom end of the container, at least a portion of the cavity defines a cosmetics accommodating space for storing the powder product, a base plug fixedly coupled at the open bottom end of the container such that the container and the base plug behave as a single unit;

an insert mounted on the container such that the insert is positioned within the cavity of the container above the cosmetics accommodating space, a roller positioned within the cosmetics accommodating space of the container, the roller is configured to rotate freely about a single axis;

an outer cap removably coupled to an upper end portion of the container;

an inner cap integrally attached to the insert;

wherein a sidewall of the insert comprises an open upper end and an open bottom end, the open bottom end of the sidewall of the insert defines an aperture;

wherein an upper surface of the sidewall of the insert forms an inner cap receiving space to receive the inner cap;

wherein at least a portion of the inner cap abuts and forms a tight seal with the insert and the roller to prevent leakage of powder product from the cosmetics accommodating space of the container;

wherein the at least a portion of the roller is disposed rotatably within the cosmetics accommodating space of the container; and wherein at least another portion of the roller extends outside the cosmetics accommodating space from the aperture located at the open bottom end of the insert;

wherein the inner cap is coupled to the insert by a hinge that allows the inner cap to be pivotally connected to the insert by at least one side; wherein the hinge is located near the open upper end of the insert; and wherein the hinge is a live hinge.

2. The cosmetic package according to claim 1, wherein two support members extend downwards from a bottom surface of the sidewall of the insert; wherein the two support members are opposingly located about a periphery of the aperture of the insert; wherein one of the roller and the two support members include two opposing axle projections and wherein other of the roller and the two support members include holes for engaging with the two opposing axle projections to allow the roller to rotate freely about an axis of the two opposing axle projections.

3. The cosmetic package according to claim 2, wherein the holes are each a see-through cavity.

4. The cosmetic package according to claim 1, wherein the insert includes an upper horizontal rim, a skirt wall that depends from an outer edge of the upper horizontal rim, and the sidewall of the insert descends downwardly from an inner edge of the upper horizontal rim.

5. The cosmetic package according to claim 4, wherein the sidewall of the insert is concave; wherein the insert includes at least one protrusion which are positioned on an inner side of the skirt wall of the insert; and wherein the at least one protrusion is configured to engage with a corresponding groove present on an outer surface of a neck portion of the container.

6. The cosmetic package according to claim 1, wherein the roller is spherical in shape.

7. The cosmetic package according to claim 1, wherein the roller is manufactured in two parts and is later integrated to form the roller; wherein the two parts of the roller comprises two halves that are semi-spherical; and wherein each of the two opposing axle projections of the roller is partially defined by the two halves of the roller.

8. The cosmetic package according to claim 1, wherein the inner cap comprises an open upper end and a closed bottom end, wherein the inner cap includes a flange projection at the open upper end thereof, a bottom wall, and a sidewall extending downwardly from the flange projection.

9. The cosmetic package according to claim 8, wherein the inner cap is configured to be received in the inner cap receiving space of the insert such that the flange projection of the inner cap rests on an upper horizontal rim of the insert, and the sidewall of the insert and the sidewall of the inner cap flush with each another, thereby enclosing the powder product within the cosmetics accommodating space of the container.

10. The cosmetic package according to claim 9, wherein an outer surface of the sidewall of the inner cap includes a protrusion that abuts and make a tight seal with the upper surface of the sidewall of the insert to prevent leakage of powder product from the container between the insert and the inner cap; wherein a bottom surface of the bottom wall of the inner cap includes an annular protrusion that rests on an outer surface of the roller, which is exposed through the aperture, to tight seal and prevents leakage of powder product from the container.

11. The cosmetic package according to claim 10, wherein an upper surface of the bottom wall of the inner cap is convex forming a concave cavity at the bottom surface of the bottom wall; wherein the concave cavity provides a space for accommodating the portion of the roller that is exposed out from the cosmetics accommodating space through the aperture of the insert.

12. A cosmetic package for discharging a powder product comprising:

a container comprising a cavity extending between an open upper end and an open bottom end of the container, at least a portion of the cavity defines a cosmetics accommodating space for storing the powder product, a base plug fixedly coupled at the open bottom end of the container such that the container and the base plug behave as a single unit;

an insert mounted on the container such that the insert is positioned within the cavity of the container above the cosmetics accommodating space, a roller positioned within the cosmetics accommodating space of the container, the roller is configured to rotate freely about a single axis;

an outer cap removably coupled to an upper end portion of the container;

an inner cap integrally attached to one of the and the insert;

wherein a sidewall of the insert comprises an open upper end and an open bottom end, the open bottom end of the sidewall of the insert defines an aperture;

wherein an upper surface of the sidewall of the insert forms an inner cap receiving space to receive the inner cap;

wherein at least a portion of the inner cap abuts and forms a tight seal with the insert and the roller to prevent leakage of powder product from the cosmetics accommodating space of the container;

wherein the at least a portion of the roller is disposed rotatably within the cosmetics accommodating space of the container; and wherein at least another portion of the roller extends outside the cosmetics accommodating space from the aperture located at the open bottom end of the insert;

wherein the inner cap extends as an annular skirt from a top wall of an inner surface of the outer cap; wherein a bottom end of the inner cap defines an annular sealing lip which has reduced thickness than rest of the inner cap; a bottom edge of the inner cap includes a protrusion that abuts and make a tight seal with the sidewall of the insert to prevent leakage of powder product from the container between the insert and the inner cap; and wherein the annular sealing lip rests on an outer surface of the roller to tight seal and prevents leakage of powder.

13. The cosmetic package according to claim 12, wherein the inner cap is concentric with a cylindrical sealing skirt of the outer cap; wherein the cylindrical sealing skirt extends from the inner surface of the top wall of the outer cap; wherein the cylindrical sealing skirt abuts and effectively seals an upper horizontal rim of the insert for sealing the container.

14. The cosmetic package according to claim 13, wherein a plurality of axial ribs extends radially inward from an inner surface of the inner cap and wherein the plurality of axial ribs reinforces structure strength of the inner cap.

15. A cosmetic package for discharging a powder product comprising:

a container comprising a cavity extending between an open upper end and an open bottom end of the container, at least a portion of the cavity defines a cosmetics accommodating space for storing the powder product, a base plug fixedly coupled at the open bottom end of the container such that the container and the base plug behave as a single unit;

an insert mounted on the container such that the insert is positioned within the cavity of the container above the cosmetics accommodating space, a roller secured to the base plug such that at least a portion of the roller is positioned within the cosmetics accommodating space of the container;

an inner cap configured to abut and make a tight seal with at least one of the insert and the roller when the cosmetic package is in a closed state;

wherein the insert comprises an aperture;

wherein the base plug comprises two support members extending upwards from a bottom wall of the base plug;

wherein the two support members are positioned diametrically opposite on the base plug;

wherein one of the roller and the two support members include two opposing axle projections, and other of the roller and the two support members include two opposing holes to rotatably accommodate the opposing axle projections for free rotation of the roller on a single axis;

wherein at least a portion of the roller is disposed rotatably within the cosmetics accommodating space of the container, and at least another portion of the roller extends outside the cosmetics accommodating space from the aperture located in the insert; and wherein as the roller rotates, an outer surface of the portion of the roller that is positioned inside the cosmetics accommodating space picks the powder product from the cosmetics accommodating space of the container and is exposed to outside from the aperture of the insert.

16. The cosmetic package according to claim 15, wherein an outer surface of a sidewall of the inner cap includes a protrusion that abuts and make a tight seal with an upper surface of a sidewall of the insert to prevent leakage of powder product from the container between the insert and the inner cap when the cosmetic package is in a closed state; and wherein a bottom surface of the inner cap includes an annular protrusion that rests on an outer surface of the roller, which is exposed through the aperture, to tight seal and prevents leakage of powder product from the container when the cosmetic package is in the closed state.

17. A cosmetic package for discharging a powder product comprising:

a container comprising a cavity extending between an open upper end and an open bottom end of the container, at least a portion of the cavity defines a cosmetics accommodating space for storing the powder product, an insert mounted on the container such that the insert is positioned within the cavity of the container above the cosmetics accommodating space, a roller comprising two opposing axle projections on an outer surface thereof;

an inner cap configured to abut and make a tight seal with the insert and the roller when the cosmetic package is in a closed state;

wherein an outer surface of the roller includes two opposing axle projections;

wherein an inner surface of a sidewall of the container includes two opposing holes to rotatably accommodate two opposing axle projections of the roller for free rotation of the roller on a single axis;

wherein at least a portion of the roller is disposed rotatably within the cosmetics accommodating space of the container, and at least another portion of the roller extends outside the cosmetics accommodating space from an aperture of the insert; and wherein as the roller rotates, the outer surface of the portion of the roller that is positioned inside the cosmetics accommodating space picks the powder product from the cosmetics accommodating space of the container and is exposed to outside from the aperture of the insert.

18. The cosmetic package according to claim 17, wherein the inner cap comprises an open upper end and a closed bottom end, wherein the inner cap includes a flange projection at the open upper end thereof, a bottom wall, and a sidewall extending downwardly from the flange projection; wherein the inner cap is configured to be received in an inner cap receiving space of the insert such that the flange projection of the inner cap rests on an upper horizontal rim of the insert, and a sidewall of the insert and the sidewall of the inner cap flush with each another, thereby enclosing the powder product within the cosmetics accommodating space of the container.

19. The cosmetic package according to claim 18, wherein an outer surface of the sidewall of the inner cap includes a protrusion that abuts and make a tight seal with an upper surface of the sidewall of the insert to prevent leakage of powder product from the container between the insert and the inner cap; wherein a bottom surface of the bottom wall of the inner cap includes an annular protrusion that rests on an outer surface of the roller, which is exposed through the aperture, to tight seal and prevents leakage of powder product from the container.

* * * * *